US011304268B2

(12) United States Patent
Takei et al.

(10) Patent No.: US 11,304,268 B2
(45) Date of Patent: Apr. 12, 2022

(54) ELECTROMAGNETIC INDUCTION HEATING APPARATUS

(71) Applicant: Bridgestone Corporation, Tokyo (JP)

(72) Inventors: Kazuya Takei, Tokyo (JP); Akihiro Nakashima, Fukuoka (JP); Yoshitaka Uchihori, Osaka (JP)

(73) Assignee: BRIDGESTONE CORPORATION, Tokyo (JP)

( * ) Notice: Subject to any disclaimer, the term of this patent is extended or adjusted under 35 U.S.C. 154(b) by 406 days.

(21) Appl. No.: 16/463,591

(22) PCT Filed: Jun. 16, 2017

(86) PCT No.: PCT/JP2017/022364
§ 371 (c)(1),
(2) Date: May 23, 2019

(87) PCT Pub. No.: WO2018/096718
PCT Pub. Date: May 31, 2018

(65) Prior Publication Data

US 2019/0380175 A1 Dec. 12, 2019

(30) Foreign Application Priority Data

Nov. 24, 2016 (JP) ..... JP2016-227518

(51) Int. Cl.
*H05B 6/10* (2006.01)

(52) U.S. Cl.
CPC ..... *H05B 6/108* (2013.01)

(58) Field of Classification Search
CPC ..... H05B 6/108
(Continued)

(56) References Cited

U.S. PATENT DOCUMENTS 2,280,102 A * 4/1942 Somes ..... H05B 6/101 219/644
2,407,562 A * 9/1946 Lofgren ..... H05B 6/108 219/630

(Continued)

FOREIGN PATENT DOCUMENTS

JP 2001155845 A 6/2001
JP 2001241769 A 9/2001
JP 2014026976 A 2/2014

OTHER PUBLICATIONS

The International Search Report issued in corresponding International Application No. PCT/JP2017/022364; dated Aug. 1, 2017.

(Continued)

*Primary Examiner* — Michael A Laflame, Jr.
*Assistant Examiner* — Ket D Dang
(74) *Attorney, Agent, or Firm* — Pearne & Gordon LLP

(57) ABSTRACT

An electromagnetic induction heating apparatus for heating a fluid includes a tubular insulating member (10) through which the fluid flows, and the tubular insulating member (10) is surrounded by an outer shell member (2, 3) exclusively of its exit-side opening (10*e*) serving as an exit for the fluid. The outer shell member (2, 3) is provided, at a position nearer to the exit-side opening (10*e*) than to an inlet-side opening (10*i*) serving as an inlet for the fluid of the tubular insulating member (10), with an inflow port (3*a*) through which the fluid flows into the outer shell member (2, 3), an electromagnetic induction coil (25) is wound around an outer periphery of the tubular insulating member (10), and a heating magnetic body (20) is disposed inside the tubular insulating member (10) in a state of forming flow paths. The above arrangement provides a small-type electromagnetic (Continued)

induction heating apparatus with which fluid heating efficiency can be enhanced and a high-pressure fluid can also be heated.

10 Claims, 3 Drawing Sheets

(58) Field of Classification Search
USPC ..... 219/630, 628, 672, 535, 602, 647, 674, 219/676; 373/142, 160–162; 392/473, 392/478, 479, 480
See application file for complete search history.

(56) References Cited

U.S. PATENT DOCUMENTS

| | | | | | |
|---|---|---|---|---|---|
| 4,089,176 | A * | 5/1978 | Ashe | H05B 6/108 | 60/650 |
| 5,872,352 | A * | 2/1999 | Suganuma | F27D 99/0006 | 219/646 |
| 5,990,465 | A * | 11/1999 | Nakaoka | H05B 6/108 | 219/629 |
| 6,046,442 | A * | 4/2000 | Kawamura | G05D 23/20 | 219/667 |
| 2002/0153369 | A1 | 10/2002 | Uemura | | |
| 2009/0159591 | A1* | 6/2009 | Tomita | B24B 49/105 | 219/628 |
| 2017/0135161 | A1* | 5/2017 | Miller | H05B 6/108 | |

OTHER PUBLICATIONS

The European Search Report issued in European Patent Application No. 17875050.1; dated Jun. 22, 2020.

* cited by examiner

ELECTROMAGNETIC INDUCTION HEATING APPARATUS

This application is a National Stage of International Application No. PCT/JP2017/022364 filed Jun. 16, 2017, claiming priority based on Japanese Patent Application No. 2016-227518 filed Nov. 24, 2016, the contents of all of which are incorporated herein by reference in their entirety.

TECHNICAL FIELD

The present invention relates to an electromagnetic induction heating apparatus for heating a fluid by a heating element that generates heat by electromagnetic induction. The fluid is, for example, a fluid to be supplied to a tire vulcanization apparatus.

BACKGROUND ART

As this kind of electromagnetic induction heating apparatus, there has been generally known an apparatus in which an electromagnetic induction coil is wound around the outer periphery of a nonmagnetic material pipe (cylindrical insulating member) permitting a fluid to pass through the inside thereof, a heating element formed of a magnetic material is disposed in the pipe through which the fluid passes, an alternating current is passed through the electromagnetic induction coil to cause the heating element to generate heat by electromagnetic induction, and the fluid is made to flow through the pipe, whereby the fluid is heated (see, for example, Patent Document 1).

PRIOR ART DOCUMENT

Patent Document

Patent Document 1
JP 2001-155845 A

The electromagnetic induction heating apparatus disclosed in Patent Document 1 has a configuration in which a coil is wound around a pipe made of a ceramic which is a nonmagnetic insulating material and excellent in heat resistance, and a heating element is disposed in the pipe, which heating element is formed of a magnetic material in a cylindrical shape and formed in the axial direction with a plurality of through-holes permitting a fluid to pass therethrough. When a high-frequency alternating current is passed from a high-frequency power source to the coil, the heating element itself generates heat by an eddy current generated in the heating element, whereby the fluid passing through the pipe can be heated.

Other than the cylindrical body formed with the plurality of through-holes, the heating element may be one in which a plurality of pipe-shaped members permitting a fluid to pass through the inside thereof are bundled. In that case, also, a nonmagnetic tubular insulating member should be disposed as a heat insulating member between the heating element and the coil, for protecting the coil.

SUMMARY OF THE INVENTION

Underlying Problems to be Solved by the Invention

The electromagnetic induction heating apparatus disclosed in Patent Document 1 is configured as above-mentioned. Although the pipe itself, around which the coil is wound, also has a heat insulating effect, fluid heating efficiency is lowered, since heat is radiated from the pipe to the exterior when the pipe is heated by the heating element on the inside thereof and the temperature thereof is raised.

In addition, since the pipe disclosed in Patent Document 1 is made of a ceramic which is a nonmagnetic insulating material, the pipe is more susceptible to breakage such as cracking than a metallic pipe or the like. Therefore, when a high-pressure fluid flows through the inside of the pipe, the pipe may be broken due to a pressure difference between the inside and the outside of the pipe.

The present invention has been made in consideration of such points. Accordingly, it is an object of the present invention to provide a small-type electromagnetic induction heating apparatus in which fluid heating efficiency can be enhanced and a high-pressure fluid can also be heated.

Means to Solve the Problems

In order to achieve the above object, according to the present invention, there is provided an electromagnetic induction heating apparatus including: a tubular insulating member that is formed in a tubular shape from a nonmagnetic material and is provided with an inlet-side opening as an opening at an end portion on one side for serving as an inlet for a fluid, and an exit-side opening as an opening at an end portion on another side for serving as an exit for the fluid; and an outer shell member that surrounds the tubular insulating member exclusively of the exit-side opening. The outer shell member is provided, at a position nearer to the exit-side opening than to the inlet-side opening of the tubular insulating member, with an inflow port through which the fluid flows to inside of the outer shell member, an electromagnetic induction coil is wound around an outer periphery of the tubular insulating member, and a heating magnetic body is disposed inside of the tubular insulating member in a state of forming a flow path.

The electromagnetic induction heating apparatus includes the tubular insulating member in which the opening at the end portion on one side is the inlet-side opening serving as an inlet for the fluid, while the opening at the end portion on the other side is the exit-side opening serving as an exit for the fluid, and the tubular insulating member is surrounded by the outer shell member exclusively of the exit-side opening. Therefore, in the outer shell member, there are configured: an annular space inside of the outer shell member and outside of an outer peripheral surface of the tubular insulating member; a tube inside space inside of the tubular insulating member; and a communication space which offers communication between the annular space and the tube inside space and on which the inlet-side opening of the tubular insulating member surrounded by the outer shell member fronts.

The outer shell member is provided with the inflow port at a position nearer to the exit-side opening than to the inlet-side opening of the tubular insulating member, and the inflow port is opening into the annular space outside of the outer peripheral surface of the tubular insulating member. The fluid flows into the annular space via the inflow port near the exit-side opening of the tubular insulating member, flows within the annular space to the inlet-side opening side of the tubular insulating member, passes through the annular space and the communication space to flow into the tube inside space inside of the tubular insulating member via the inlet-side opening of the tubular insulating member, passes through the tube inside space, and flows out via the exit-side opening of the tubular insulating member that is not surrounded by the outer shell member.

When the heating magnetic body inside the tubular insulating member generates heat by electromagnetic induction by the electromagnetic induction coil, the tubular insulating member is heated and its temperature is raised. The fluid flowing into the annular space through the inflow port is preliminarily heated in the annular space surrounded by the outer shell member by the heat radiation from the tubular insulating member raised in temperature, after which the fluid goes around the communication space, and passes through the flow paths formed in the heating magnetic body inside of the tubular insulating member, while being directly heated by the heating magnetic body generating heating. Therefore, the fluid flowing into the annular space through the inflow port is efficiently heated through the two stages of heating, namely, a first stage of heating in the annular space and a second stage of heating in the tube inside space, and, accordingly, the fluid heating efficiency is extremely high.

In addition, in the interior of the outer shell member, the annular space outside of the tubular insulating member and the tube inside space inside of the tubular insulating member constitute a single common space together with the communication space. Therefore, even when the fluid flowing in is at a high pressure, there is no difference between the pressures exerted respectively on the outer peripheral surface and the inner peripheral surface of the tubular insulating member, and no stress is generated in the tubular insulating member, so that breakage such as cracking is not generated in the tubular insulating member.

Further, since the tubular insulating member is surrounded by the outer shell member exclusively of the exit-side opening, the tubular insulating member is accommodated in the interior of the outer shell member, and the electromagnetic induction heating apparatus can be reduced in size. Even with the electromagnetic induction heating apparatus reduced in size, the fluid passes sequentially through the two heating spaces, namely, the annular space and the tube inside space, so that the flow path length over which the fluid is heated can be elongated, and the fluid can be sufficiently heated.

In a preferred embodiment of the present invention, the outer shell member is made of a magnetic material.

According to this configuration, since the outer shell member is made of a magnetic material, the outer shell member also generates heat through electromagnetic induction by the electromagnetic induction coil disposed inside of the outer shell member. Therefore, the fluid flowing into the annular space via the inflow port is not only heated by the internal heat radiation from the tubular insulating member heated and raised in temperature by the heat generation of the heating magnetic body inside the tubular insulating member, but also heated from outside due to the heat generation by the outer shell member. Consequently, the first stage of heating in the annular space is performed effectively.

According to a preferred embodiment of the present invention, the outer shell member is made up of a bottomed tubular container having a tubular wall section with a closed bottom wall at one end and an opening at another end, and a plate-shaped base plate closing the opening of the bottomed tubular container and provided with an outflow port, and the exit-side opening of the tubular insulating member is connected to the outflow port provided in the base plate.

According to this configuration, the outer shell member includes the bottomed tubular container, and the flat plate-shaped base plate that is provided with the outflow port and that closes an opening of the bottomed tubular container, and the exit-side opening of the tubular insulating member that is not surrounded by the outer shell member is connected to the outflow port provided in the base plate. Therefore, a structure is provided in which the tubular insulating member is provided on the base plate by connecting the exit-side opening of the tubular insulating member to the outflow port of the base plate, and the bottomed tubular container covers the tubular insulating member such as to accommodate the tubular insulating member in the inside thereof. Accordingly, by a simple operation of detaching the bottomed tubular container from the base plate provided with the tubular insulating member, the tubular insulating member having been covered by the bottomed tubular container can be exposed to the exterior together with the electromagnetic induction coil, and maintenance can be performed easily.

According to another preferred embodiment of the present invention, the inflow port is provided in the base plate.

According to this configuration, the inflow port provided nearer to the exit-side opening than to the inlet-side opening of the tubular insulating member is provided in the base plate. Therefore, the fluid flowing in through the inflow port provided in the base plate flows within the annular space outside of the outer peripheral surface of the tubular insulating member over the whole length in the axial direction, and receives almost entirely the heat radiation from the tubular insulating member raised in temperature. Accordingly, the first stage of heating of the fluid is performed efficiently. In addition, since the base plate is provided with the inflow port and the outflow pipe, pipings from outside are also collected into the base plate. Therefore, the bottomed tubular container can be easily detached from the base plate, and maintenance in the surroundings of the tubular insulating member can be carried out easily.

According to a further embodiment of the present invention, the tubular wall section of the bottomed tubular container is a cylindrical wall section, and the tubular insulating member is cylindrical in shape, and is disposed inside the cylindrical wall section of the bottomed tubular container with their respective cylinder center axes coincident with each other.

According to this configuration, the tubular wall section of the bottomed tubular container is the cylindrical wall section, and the tubular insulating member cylindrical in shape is disposed inside the cylindrical wall section of the bottomed tubular container with their respective cylinder center axes coincident with each other. Therefore, the annular space outside of the outer peripheral surface of the tubular insulating member cylindrical in shape constitutes a cylindrical space inside the cylindrical wall section, and the fluid can smoothly flow within the annular space without resistance, so that pressure loss in the fluid can be reduced.

In a preferred embodiment of the present invention, the outflow port constitutes a tubular outflow pipe that penetrates the base plate and is secured to the base plate.

According to this configuration, the outflow port is provided by the tubular outflow pipe that penetrates the base plate and is secured to the base plate. Therefore, a structure is realized such that the annular space outside of the tubular insulating member and the tube inside space inside of the tubular insulating member are extended by the outflow pipe. Accordingly, the flow path for the fluid inside the outer shell member is elongated, and the fluid can be heated more.

In another preferred embodiment of the present invention, the bottomed tubular container has a bottom wall section bulging in a dome-like shape.

According to this configuration, with the bottom wall section of the bottomed tubular container bulging in a dome-like shape, the fluid flowing into the annular space through the inflow port can smoothly flow around the dome-shaped bottom surface of the communication space to flow into the tubular insulating member. Therefore, pressure loss in the fluid can be reduced.

In a still preferred embodiment of the present invention, the tubular insulating member is made of a nonmagnetic ceramic.

According to this configuration, with the tubular insulating member made of a nonmagnetic ceramic, the tubular insulating member does not generate heat by electromagnetic induction. In addition, since the tubular insulating member also has a heat insulating effect, it can protect the electromagnetic induction coil wound around the outer periphery thereof. Further, since the tubular insulating member does not undergo thermal deformation, it can securely hold the electromagnetic induction coil.

In another embodiment of the present invention, the electromagnetic induction coil has a heat-resistant structure.

According to this configuration, with the electromagnetic induction coil having the heat-resistant structure, it is ensured that even when the annular space outside of the tubular insulating member around which the electromagnetic induction coil is wound is brought to a high temperature, oxidation of the electromagnetic induction coil is prevented, a sufficient electric conductivity can be secured, and burning or the like can be prevented.

In a further preferred embodiment of the present invention, the heating magnetic body has a plurality of flow paths arrayed such as to extend rectilinearly from the inlet-side opening serving as an inlet for the fluid of the tubular insulating member toward the exit-side opening.

According to this configuration, since the heating magnetic body has a structure in which a plurality of flow paths extending rectilinearly from the inlet-side opening toward the exit-side opening of the tubular insulating member are arrayed, pressure loss in the fluid can be reduced. In addition, the heating magnetic body has a shape substantially uniform in the direction in which magnetic lines of force of the electromagnetic induction coil pass (the center axis direction of the tubular insulating member), so that local heat generation is prevented, and the fluid can be heated efficiently.

Effects of the Invention

According to the present invention, the fluid flowing into the annular space through the inflow port is preliminarily heated in the annular space, after which the fluid flows around the communication space, and flows into the tube inside space, to be directly heated by the heating magnetic body. Thus, the high-pressure nitrogen gas is efficiently heated in two stages in the annular space and the tube inside space, before flowing out, so that the fluid heating efficiency is enhanced.

In addition, in the interior of the outer shell member, the annular space outside of the tubular insulating member and the tube inside space inside of the tubular insulating member constitute a single common space together with the communication space. Therefore, even when the fluid flowing in is at a high pressure, there is no difference between the pressures exerted respectively on the outer peripheral surface and the inner peripheral surface of the tubular insulating member, and no stress is generated in the tubular insulating member, so that breakage such as cracking is not generated in the tubular insulating member.

Further, since the tubular insulating member is surrounded by the outer shell member exclusively of the exit-side opening, the tubular insulating member is accommodated in the interior of the outer shell member, and the electromagnetic induction heating apparatus can be reduced in size. Even with the electromagnetic induction heating apparatus reduced in size, the fluid passes sequentially through the two heating spaces, namely, the annular space and the tube inside space, and, therefore, the flow path length over which the fluid is heated can be elongated, and the fluid can be heated sufficiently.

MODES FOR CARRYING OUT THE INVENTION

Figure 1:
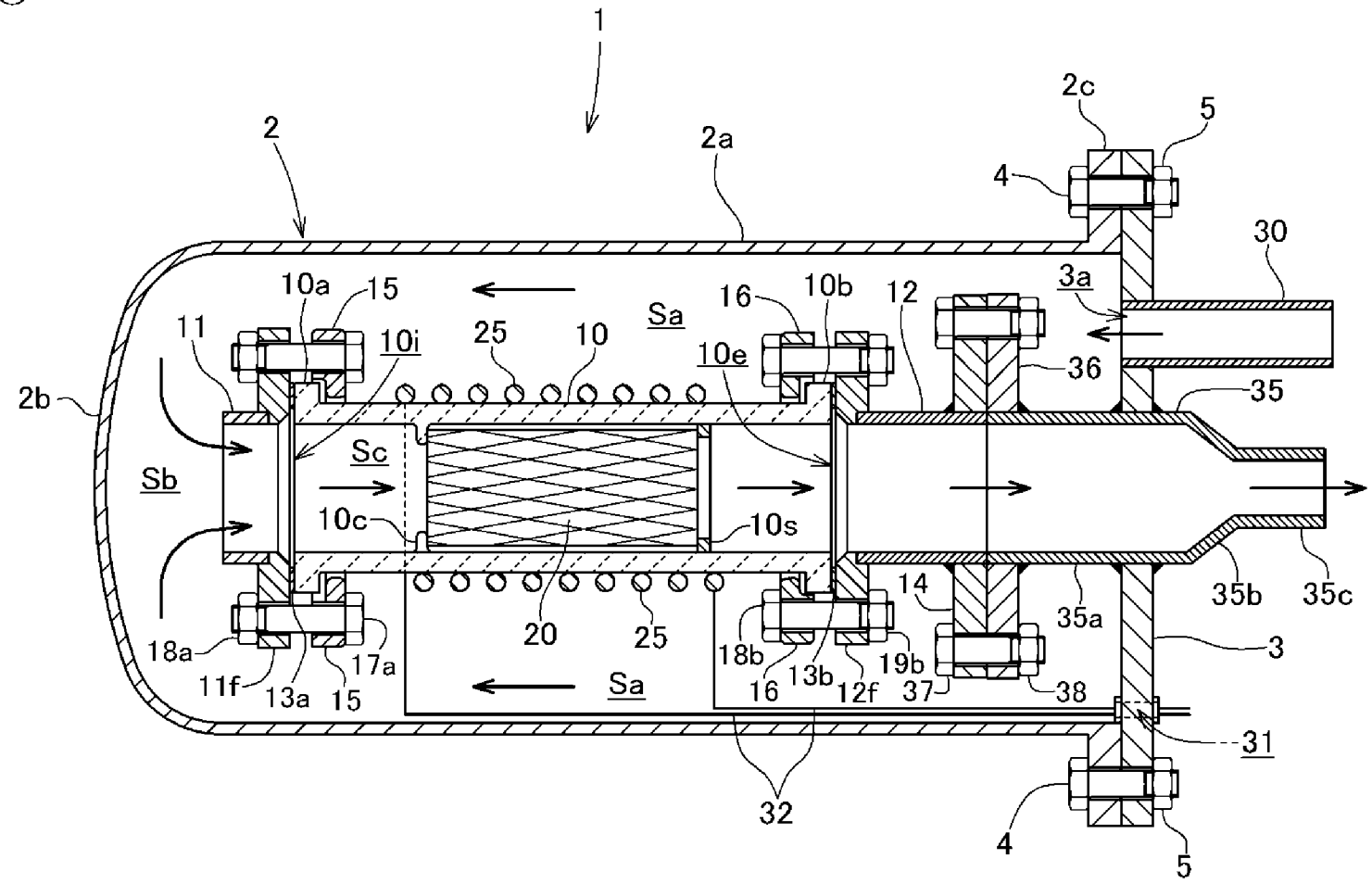
FIG. 1 is a longitudinal sectional view of an electromagnetic induction heating apparatus according to an embodiment of the present invention.
Figure 2:
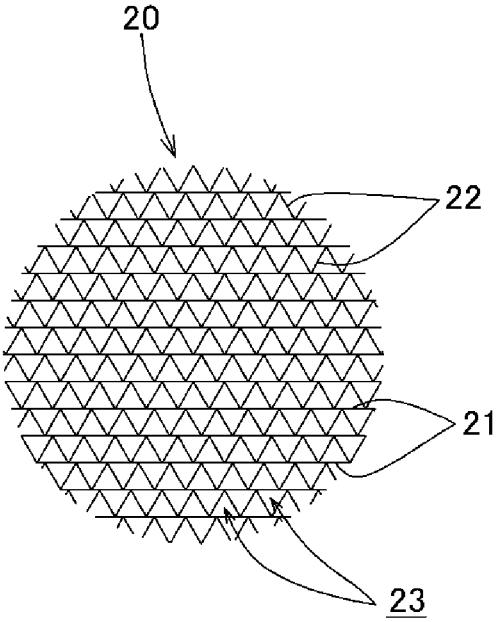
FIG. 2 is a transverse sectional view of a heating magnetic body constituting part of the electromagnetic induction heating apparatus according to the embodiment.

Embodiments of the present invention will be described below with reference to the drawings. FIGS. 1 and 2 denote an embodiment of the present invention. FIG. 1 shows a longitudinal sectional view of an electromagnetic induction heating apparatus 1 according to an embodiment of the present invention. The electromagnetic induction heating apparatus 1 is for heating a fluid, particularly, a gas, and is an apparatus for heating a high-pressure gas by electromagnetic induction and discharging the heated gas. In the present embodiment, a high-pressure nitrogen gas which is a high-pressure inert gas is used.

The electromagnetic induction heating apparatus 1 has an outer shell member configured using a bottomed tubular container 2 and a base plate 3. The bottomed tubular container 2 of the outer shell member is a pressure-resistant container made of stainless steel, and has a bottom wall section 2*b* bulging in a dome-like form at one end of a cylindrical wall section 2*a*. An attachment flange 2*c* is provided at an opening end portion, on the side opposite to the bottom wall section 2*b*, of the cylindrical wall section 2*a*.

The base plate 3 is a disk-shaped metallic plate, is put to close an opening of the bottomed tubular container 2, and is put in contact with the attachment flange 2*c* of the bottomed tubular container 2. The attachment flange 2*c* and the base plate 3 are fastened together by screw engagement between bolts 4 penetrating them and nuts 5, whereby the bottomed tubular container 2 is attached to the base plate 3. The base plate 3 is provided in its center with an outflow pipe 35.

In the inside of the bottomed tubular container 2, a tubular insulating member 10 coaxially cylindrical in shape is inserted in the state of not making contact with the bottomed tubular container 2. The tubular insulating member 10 is a molded product of silicon nitride, which is a non-oxide ceramic of a nonmagnetic material, formed in a cylindrical shape having an outside diameter smaller than the inside diameter of the cylindrical wall section 2*a* of the bottomed tubular container 2. Silicon nitride is a nonmagnetic material, is highly corrosion resistant to acids and alkalis, and is excellent in thermal shock resistance.

The tubular insulating member 10 is formed at both end portions thereof with flange sections 10*a* and 10*b*. The flange section 10*a* is located on the side of the bottom wall section 2*b* of the bottomed tubular container 2, while the flange section 10*b* is located on the opening side of the bottomed tubular container 2. In the tubular insulating member 10, the flange section 10*a* is formed at an opening end portion of an inlet-side opening 10*i* serving as an inlet for a fluid, and the flange section 10*b* is formed at an opening end portion of an exit-side opening 10*e* serving as an exit for the fluid, in regard of the flow direction of the fluid in the tubular insulating member 10.

A heating magnetic body 20 is disposed inside the tubular insulating member 10. The heating magnetic body 20 includes flat plate-shaped sheet members 21 and corrugated plate-shaped sheet members 22, as depicted in transverse sectional view in FIG. 2. The flat plate-shaped sheet members 21 and corrugated plate-shaped sheet members 22 are both made of stainless steel, and is a stacked body in which the flat plate-shaped sheet members 21 being flat and the corrugated plate-shaped sheet members 22 formed in a corrugated shape by alternate repetition of mounts and valleys are alternately stacked.

The heating magnetic body 20 is cylindrical in overall outline shape, in which the outside diameter of the stacked body is slightly smaller than the inside diameter of the tubular insulating member 10. The heating magnetic body 20, with the flat plate-shaped sheet members 21 and the corrugated plate-shaped sheet members 22 alternately stacked, has a structure in which a plurality of flow paths 23 formed rectilinearly are arrayed. Each flow path 23 in the heating magnetic body 20 disposed inside the tubular insulating member 10 extends rectilinearly from the inlet-side opening 10*i* toward the exit-side opening 10*e* of the tubular insulating member 10, and the direction in which the flow path 23 is directed is not parallel to, but has a slight angle relative to, a center axis of a cylinder of the outline shape of the heating magnetic body 20.

An inner peripheral surface of the tubular insulating member 10 is formed, at a part near the side of the inlet-side opening 10*i* on one side, with a plurality of projected portions 10*c* in a circumferential direction. Into the inside of the tubular insulating member 10, the heating magnetic body 20 cylindrical in outline shape is inserted starting with the inlet-side opening 10*i*, after which an annular stopper member 10*s* fitted in the inside of the tubular insulating member 10 interposes the heating magnetic body 20 between itself and the plurality of projected portions 10*c*, with some allowance, whereby the heating magnetic body 20 is disposed at position.

Therefore, the heating magnetic body 20 cylindrical in outline shape is inserted in the inside of the tubular insulating member 10 with some allowance between itself and the inner peripheral surface of the tubular insulating member 10, and is disposed between the projected portions 10*c* and the annular stopper member 10*s* with some allowance in the axial directions. Accordingly, even when the heating magnetic body 20 generates heat and is thermally expanded, the expansion is absorbed by the allowance gaps.

Besides, an electromagnetic induction coil 25 is wound around the outer periphery of the tubular insulating member 10 in an axial area where the heating magnetic body 20 exists. The electromagnetic induction coil 25 has an anti-oxidation heat-resistant structure in which an outer periphery of a conductor is plated with nickel, and glass fibers are arranged on the plating.

The heat-resistant structure for the electromagnetic induction coil includes air cooling in which heat resistance is offered by a coil structure and liquid cooling in which cooling is promoted by a liquid with a pipe coil structure to thereby offer heat resistance. For example, the electromagnetic induction coil may have a pipe coil structure using a copper pipe or the like, and cooling water or a cooling oil may be caused to flow inside the pipe to cool the pipe, whereby oxidation of the electromagnetic induction coil can be prevented, and burning or the like can simultaneously be prevented.

Thus, the tubular insulating member 10 with the heating magnetic body 20 accommodated therein and with the electromagnetic induction coil 25 wound therearound has the flange sections 10*a* and 10*b* at both the end portions thereof, and metallic cylindrical end members 11 and 12 are attached to the flange sections 10*a* and 10*b*, respectively. The cylindrical end members 11 and 12 have a flattened cylindrical shape short in the axial direction and equal in inside diameter to the tubular insulating member 10, and have flange members 11*f* and 12*f* attached to one-side ends thereof.

The flange member 11*f* of the cylindrical end member 11 is attached to the flange section 10*a* at one end of the tubular insulating member 10 with a packing 13*a* interposed therebetween, a pair of half-split annular members 15 are opposed to the flange member 11*f* in such a manner as to interpose the flange section 10*a* therebetween, and the flange member 11*f* and the half-split annular members 15 are fastened together by screw engagement of bolts 17*a* penetrating them and nuts 18*a*, whereby the cylindrical end member 11 is attached to the one end of the tubular insulating member 10.

Similarly, the flange member 12*f* of the cylindrical end member 12 is attached to the flange section 10*b* at the other end of the tubular insulating member 10 with a packing 13*b* interposed therebetween, a pair of half-split annular members 16 are opposed to the flange member 12*f* in such a manner as to interpose the flange section 10*b* therebetween, and the flange member 12*f* and the half-split annular members 16 are fastened together by screw engagement between bolts 17*b* penetrating them and nuts 18*b*, whereby the cylindrical end member 12 is attached to the other end of the tubular insulating member 10.

Thus, the ceramic-made tubular insulating member 10 with the heating magnetic body 20 accommodated therein and with the electromagnetic induction coil 25 wound therearound is attached to the base plate 3, and is inserted in the bottomed tubular container 2, in the state of being unitized by attaching the metallic cylindrical end members 11 and 12 to both ends thereof.

The base plate 3 is provided in its center with the outflow pipe 35 that penetrates and is secured to the base plate 3. The outflow pipe 35 has a structure in which one end of a large-diameter cylindrical section 35*a* equal in diameter to the cylindrical end member 12 is concentrically drawn to form a conical section 35*b* and a small-diameter cylindrical section 35*c*. The outflow pipe 35 has its large-diameter cylindrical section 35*a* secured to the base plate 3, and has its small-diameter cylindrical section 35*c* protruding to the exterior.

The base plate 3 in the surroundings of the outflow pipe 35 is provided with an inflow port 3*a* communicating with the inside of the bottomed tubular container 2, and an inflow pipe 30 is fitted into the inflow port 3*a* from outside. In addition, the base plate 3 is provided with a cable passing port 31 which a power cable 32 extending from the electromagnetic induction coil 25 penetrates in an airtight fashion from the inside of the bottomed tubular container 2 to the exterior.

A flange member 36 is fitted to an end portion of the large-diameter cylindrical section 35*a* of the outflow pipe 35. On the other hand, a flange member 14 is fitted onto the cylindrical end member 12 attached to the opening end portion of the exit-side opening 10*e* of the tubular insulating member 10. The flange member 14 of the cylindrical end member 12 is put in contact with the flange member 36 of the outflow pipe 35, bolts 37 are made to penetrate the flange members and put into screw engagement with nuts 38, followed by tightening, whereby the cylindrical end member 12 and the large-diameter cylindrical section 35*a* of the outflow pipe 35 are connected together, and the tubular insulating member 10 is attached to the outflow pipe 35 secured to the base plate 3, with the cylindrical end member 12 interposed therebetween.

The electromagnetic induction heating apparatus 1 is configured as above, the tubular insulating member 10 is coaxially inserted in the inside of the bottomed tubular container 2, and the opening of the bottomed tubular container 2 is closed with the base plate 3, whereby the tubular insulating member 10 is surrounded by the bottomed tubular container 2 and the base plate 3 exclusively of the exit-side opening 10*e* of the tubular insulating member 10. Therefore, on the inside of the bottomed tubular container 2 and the base plate 3, an annular space Sa is formed on the outside of the tubular insulating member 10 and on the inside of the cylindrical wall section 2*a* of the bottomed tubular container 2. Further, a tube inside space Sc is defined inside the tubular insulating member 10, and a communication space Sb offering communication between the annular space Sa and the tube inside space Sc is formed between a bottom surface of the bottom wall section 2*b* of the bottomed tubular container 2 and the inlet-side opening 10*i* of the tubular insulating member 10.

When the electromagnetic induction coil 25 wound around the tubular insulating member 10 is supplied with a high-frequency current through the power cable 32, a high-frequency magnetic flux generated by the electromagnetic induction coil 25 acts on the heating magnetic body 20 in the tubular insulating member 10, to generate an eddy current in the heating magnetic body 20, whereby Joule heat is generated due to specific resistance of the heating magnetic body 20, namely, the heating magnetic body 20 generates heat. In addition, the bottomed tubular container 2 covering the electromagnetic induction coil 25 from outside together with the tubular insulating member 10 is also made of stainless steel, and generates heat through electromagnetic induction by the electromagnetic induction coil 25.

By the heat generation of the heating magnetic body 20, the flow paths 23 configured in the heating magnetic body 20 are heated directly, and the tube inside space Sc inside the tubular insulating member 10 is also heated. In addition, although the tubular insulating member 10 does not generate heat by electromagnetic induction, it is heated and its temperature is raised by the heat generation by the heating magnetic body 20 from inside, and, due to heat radiation from the tubular insulating member 10 thus raised in temperature, the annular space Sa covered with the bottomed tubular container 2 is also heated indirectly. Further, the annular space Sa is heated from outside by the bottomed tubular container 2 which generates heat by electromagnetic induction.

A high-pressure nitrogen gas flows from a gas pressurizing and supplying apparatus (not depicted) or the like into the bottomed tubular container 2 of the electromagnetic induction heating apparatus 1 through the inflow pipe 30. The high-pressure nitrogen gas flows into the annular space Sa in the bottomed tubular container 2 through the inflow pipe 30 nearer to the exit-side opening 10*e* than to the inlet-side opening 10*i* of the tubular insulating member 10, and flows within the annular space Sa over the whole length from the side of the exit-side opening 10*e* to the side of the inlet-side opening 10*i* of the tubular insulating member 10. During this process, the high-pressure nitrogen gas is preliminarily heated efficiently in the annular space Sa covered with the bottomed tubular container 2 by the heat radiation of the tubular insulating member 10 raised in temperature and the heat generation of the bottomed tubular container 2.

Thereafter, the high-pressure nitrogen gas thus preliminarily heated goes around the communication space Sb to flow into the tube inside space Sc via the cylindrical end member 11 at the opening end portion of the inlet-side opening 10*i* of the tubular insulating member 10, and passes through the plurality of flow paths 23 formed rectilinearly in the heating magnetic body 20 (which is generating heat) in the tube inside space Sc, whereby the high-pressure nitrogen gas is heated directly by the heating magnetic body 20 generating heat, before exiting through the exit-side opening 10*e* of the tubular insulating member 10 and flowing into the outflow pipe 35 and flowing out through the outflow pipe 35.

In this way, the high-pressure nitrogen gas flowing through the inflow pipe 30 into the annular space Sa undergoes first-stage heating in the annular space Sa on the upstream side and second-stage heating in the tube inside space Sc on the downstream side; thus, the high-pressure nitrogen gas is efficiently heated by the two-stage heating, before flowing out as a high-temperature high-pressure nitrogen gas. The thus heated high-pressure nitrogen gas is supplied to a desired apparatus, for example, a tire vulcanization apparatus or the like.

As has been described above, in the present electromagnetic induction heating apparatus 1, when the heating magnetic body 20 inside the tubular insulating member 10 and the bottomed tubular container 2 outside the tubular insulating member 10 generate heat due to the high-frequency magnetic flux generated by the electromagnetic induction coil 25, the tubular insulating member 10 is heated and its temperature is raised by the heating magnetic body 20. As a result, the high-pressure nitrogen gas flowing into the annular space Sa via the inflow port 3*a* of the base plate 3 through the inflow pipe 30 is preliminarily heated by the heat radiation of the tubular insulating member 10 raised in temperature and the heat generation of the bottomed tubular container 2. Thereafter, the high-pressure nitrogen gas thus preliminarily heated goes around the communication space Sb to flow into the tube inside space Sc of the tubular insulating member 10, and passes through the flow paths 23 formed in the heating magnetic body 20 in the tube inside space Sc, whereby the high-pressure nitrogen gas is heated directly by the heating magnetic body 20 generating heat, before flowing out via the outflow pipe 35. Therefore, the present electromagnetic induction heating apparatus 1 is extremely high in nitrogen gas heating efficiency, since the high-pressure nitrogen gas is efficiently heated through the two-stage heating in the annular space Sa and the tube inside space Sc.

In addition, in the inside of the pressure-resistant bottomed tubular container 2 into which the high-pressure nitrogen gas flows, the annular space Sa outside of the tubular insulating member 10 and the tube inside space Sc inside of the tubular insulating member 10 constitute a single common space together with the communication space Sb. Therefore, even when the nitrogen gas flowing in is at a considerably high pressure, no difference exists between the pressures exerted respectively on an outer peripheral surface and an inner peripheral surface of the ceramic-made tubular insulating member 10, so that no stress is generated in the tubular insulating member 10, and breakage such as cracking is not generated.

In the present electromagnetic induction heating apparatus 1, by the tubular insulating member 10 coaxially inserted in the bottomed tubular container 2, the annular space Sa outside of the tubular insulating member 10 and inside of the cylindrical wall section 2*a* of the bottomed tubular container 2 and the tube inside space Sc inside of the tubular insulating member 10 are formed, and the communication space Sb is formed between the bottom surface of the bottom wall section 2*b* of the bottomed tubular container 2 and the inlet-side end portion of the tubular insulating member 10 opposed to the bottom surface. Therefore, the fluid goes around from the annular space Sa on the outside into the tube inside space Sc on the inside, so that the flow path length is enlarged and the fluid can be heated sufficiently. In addition, the electromagnetic induction heating apparatus 1 can be reduced in size through a reduction in the width in the longitudinal direction.

The inflow port 3*a* is provided in the base plate 3, and the tubular insulating member 10 with the electromagnetic induction coil 25 wound therearound is integrally assembled onto the base plate 3 through the outflow pipe 35. Therefore, by a simple operation of detaching the bottomed tubular container 2, which is put such as to cover the tubular insulating member 10 integrally assembled onto the base plate 3, from the base plate 3 by unfastening the bolts 4 and nuts 5, the tubular insulating member 10 integrally assembled onto the base plate 3 is exposed to the exterior. Consequently, maintenance of the electromagnetic induction coil 25 and the heating magnetic body 20 and the like can be carried out easily.

The ceramic-made tubular insulating member 10 with the heating magnetic body 20 accommodated therein and with the electromagnetic induction coil 25 wound therearound is unitized by attaching the metallic cylindrical end members 11 and 12 respectively to both ends thereof. Therefore, by detaching the thus unitized assembly from the outflow pipe 35, which penetrates and is secured to the base plate 3, and by unfastening the bolts 37 and the nuts 38, the unit as a whole can also be replaced easily.

The inflow pipe 30 (the inflow port 3*a*) provided nearer to the exit-side opening 10*e* than to the inlet-side opening 10*i* of the tubular insulating member 10 is provided in the base plate 3. Therefore, the fluid flowing in through the inflow pipe 30 provided in the base plate 3 flows within the annular space Sa outside of the outer peripheral surface of the tubular insulating member 10, over the whole length in the axial direction from the side of the exit-side opening 10*e* to the side of the inlet-side opening 10*i* of the tubular insulating member 10. During this process, the high-pressure nitrogen gas receives almost entirely the heat radiation from the tubular insulating member 10 raised in temperature, whereby a first stage of heating of the high-pressure nitrogen gas is performed efficiently. In addition, since the inflow pipe 30 and the outflow pipe 35 are provided at the base plate 3, pipings from outside are also collected into the base plate 3. Therefore, the bottomed tubular container 2 can be easily detached from the base plate 3, and maintenance of the electromagnetic induction coil 25 and the like in the surroundings of the tubular insulating member 10 can be conducted easily.

The tubular insulating member 10 cylindrical in shape is disposed inside the cylindrical wall section 2*a* of the bottomed tubular container 2 with their respective cylinder center axes coincident with each other. Therefore, the annular space Sa inside of the cylindrical wall section 2*a* and outside of the outer peripheral surface of the tubular insulating member 10 cylindrical in shape constitute a space which is cylindrical in shape, so that the fluid can flow smoothly within the annular space Sa without resistance, and pressure loss in the fluid can be reduced.

Since the outflow port for the high-pressure nitrogen gas is configured by the tubular outflow pipe 35 that penetrates and is secured to the base plate 3, a structure is realized in which the annular space Sa outside of the tubular insulating member 10 and the tube inside space Sc inside of the tubular insulating member 10 are elongated by the outflow pipe 35. Therefore, the flow path for the fluid inside the bottomed tubular container 2 is elongated, so that the fluid can be heated more.

The bottom wall section 2*b* of the bottomed tubular container 2 is bulging in a dome-like shape. This permits the fluid flowing into the annular space Sa through the inflow port 3*a* to smoothly go around the dome-shaped bottom surface of the communication space Sb and to flow into the tubular insulating member 10. Therefore, pressure loss in the fluid can be reduced.

Since the tubular insulating member 10 is configured using silicon nitride which is a non-oxide ceramic, the tubular insulating member 10 itself does not generate heat by electromagnetic induction. In addition, the tubular insulating member 10 also has a heat-insulating effect. Therefore, the electromagnetic induction coil 25 wound around the outer periphery of the tubular insulating member 10 can be protected. Besides, the tubular insulating member 10 does not undergo thermal deformation, and, therefore, can securely hold the electromagnetic induction coil 25.

The electromagnetic induction coil 25 has an anti-oxidation heat-resistant structure in which an outer periphery of a conductor is plated with nickel and glass fibers are arranged on the plating. Therefore, even when the annular space Sa outside of the tubular insulating member 10 with the electromagnetic induction coil 25 wound therearound is brought to a high temperature, oxidation of the electromagnetic induction coil 25 is prevented, a sufficient electric conductivity can be secured, and burning or the like can be prevented.

Referring to FIG. 2, the heating magnetic body 20 has a structure in which the flat plate-shaped sheet members 21 and the corrugated plate-shaped sheet members 22 are alternately stacked, whereby the plurality of flow paths 23 extending rectilinearly from the inlet-side opening 10*i* toward the exit-side opening 10*e* of the tubular insulating member 10 are arrayed. Therefore, pressure loss in the fluid can be reduced, and, due to the shape substantially uniform in the direction in which magnetic lines of force of the electromagnetic induction coil 25 pass (the center axis direction of the tubular insulating member 10), local heat generation is prevented, and the fluid can be efficiently heated.

The direction in which the flow paths 23 extending rectilinearly from the inlet-side opening 10*i* toward the exit-side opening 10*e* of the tubular insulating member 10 are directed in the heating magnetic body 20 is not parallel to, but has a slight angle relative to, the center axis of the cylinder of the outline shape of the heating magnetic body 20. Therefore, the rectilinear flow paths having a slight angle relative to the center axis of the cylinder of the outline shape of the heating magnetic body 20 can be set longer than the length in the center axis direction (longitudinal width) of the outline shape, whereby the fluid can be heated more. In addition, by reducing the longitudinal width of the heating magnetic body 20, the longitudinal width of the electromagnetic induction heating apparatus 1 can be reduced, and the size of the electromagnetic induction heating apparatus 1 can be reduced.

In the electromagnetic induction heating apparatus 1 as described above, the heating magnetic body 20 has had the structure in which the flat plate-shaped sheet members 21 and the corrugated plate-shaped sheet members 22 which are made of stainless steel are alternately stacked, whereby the plurality of flow paths extending rectilinearly are arrayed. However, a heating magnetic body formed by bundling magnetic pipes, for example, stainless steel pipes, may also be used.

Figure 3:
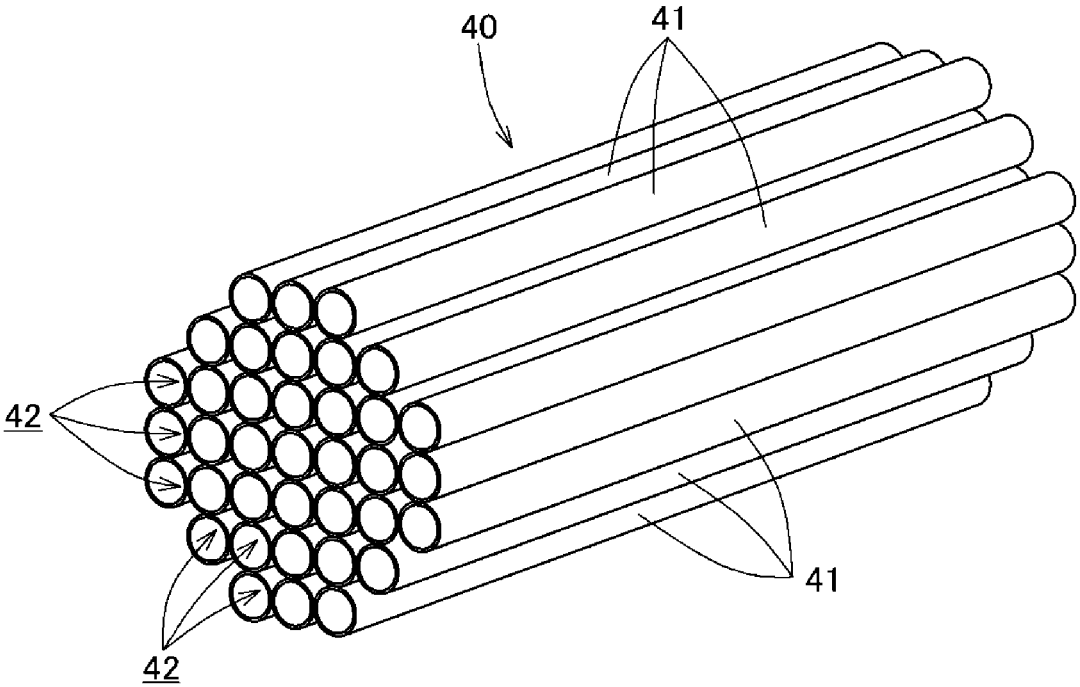
FIG. 3 is a perspective view of a heating magnetic body according to another embodiment.

FIG. 3 is a perspective view of a heating magnetic body 40 formed by bundling stainless steel pipes 41. A plurality of pipes 41 having the same diameter are bundled together into a roughly circular overall shape, and are welded together, to constitute the heating magnetic body 40. When the heating magnetic body 40 is disposed in the tubular insulating member 10 cylindrical in shape, a structure is realized in which the plurality of flow paths 42 defined by the pipes 41 extending rectilinearly from the inlet-side opening toward the exit-side opening of the tubular insulating member 10 are arrayed. Therefore, pressure loss in the fluid can be reduced, and, due to the shape substantially uniform in the direction in which the magnetic lines of force of the electromagnetic induction coil 25 pass (the center axis direction of the tubular insulating member 10), local heat generation is prevented, and the fluid can be heated efficiently.

Figure 4:
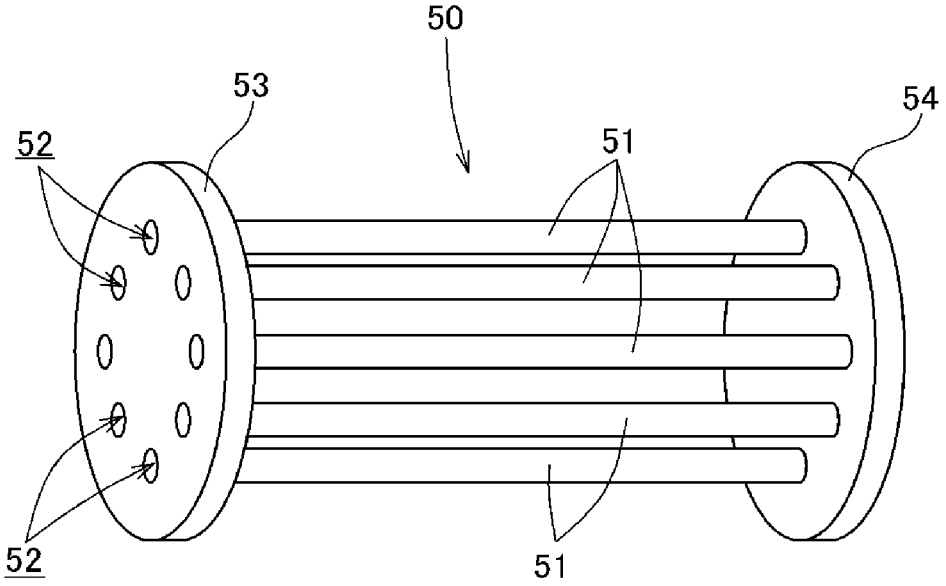
FIG. 4 is a transverse sectional view of a heating magnetic body according to a further embodiment.

In addition, a heating magnetic body 50 depicted in FIG. 4 has a structure in which both ends of each of a plurality of stainless steel pipes 51 are fitted respectively to a pair of flange members 53 and 54 opposed to each other, and each pipe 51 is supported by the pair of flange members 53 and 54. Each of flow paths 52 defined by the pipes 51 extends rectilinearly from an inlet-side end portion fitted to the flange member 53 on one side toward an exit-side end portion fitted to the flange member 54 on the other side, and the flow paths 52 are arrayed in parallel to one another. Therefore, pressure loss in the fluid can be reduced, local heat generation can be prevented, and the fluid can be heated efficiently. Besides, in the present heating magnetic body 50, it is unnecessary to weld the pipes to one another, the number of component parts can be reduced, and assembly work can be facilitated.

Figure 5:
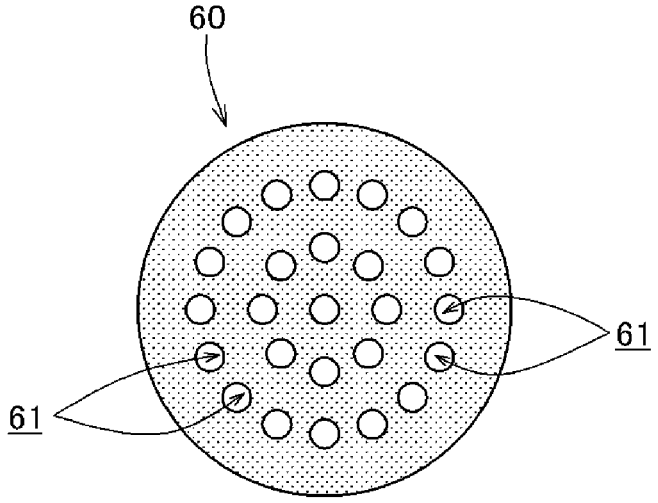
FIG. 5 is a transverse sectional view of a heating magnetic body according to a yet further embodiment.

In addition, as the heating magnetic body, there may be used one that is formed by molding and sintering a metallic powder by a powder metallurgy method. FIG. 5 is a transverse sectional view of a heating magnetic body 60 formed by a powder metallurgy method. In the heating magnetic body 60, a magnetic stainless steel-base plated metallic powder is molded into a cylindrical shape and sintered by a powder metallurgy method, and a plurality of flow paths 61 are rectilinearly formed in the sintered cylindrical body by penetration processing by a drill. Such a heating magnetic body 60 is disposed in the tubular insulating member 10, in place of the heating magnetic body 20 of the above-described embodiment.

Like in the above-described embodiment, when the heating magnetic body 60 in the tubular insulating member 10 generates heat by a high-frequency magnetic flux generated by the electromagnetic induction coil 25, the tubular insulating member 10 is heated and its temperature is raised. A fluid flowing into the annular space Sa through the inflow pipe 30 (inflow port 3*a*) is preliminarily heated in the annular space Sa covered by the bottomed tubular container 2 by the heat radiation from the tubular insulating member 10 raised in temperature, after which the fluid passes through the flow paths 61 formed in the heating magnetic body 60 inside of the tubular insulating member 10, and is directly heated by the heating magnetic body 60 generating heating. Thus, the high-pressure nitrogen gas is efficiently heated in two stages in the annular space Sa on the upstream side and in the tube inside space Sc on the downstream side. Therefore, nitrogen gas heating efficiency is extremely high.

It is to be noted, however, that since the portions between the plurality of flow paths 61 in the heating magnetic body 60 are solid and thick, the pressure loss property in the fluid is inferior to that in the above-described embodiment. Other than the above, examples of the heating magnetic body include one in which a honeycomb member of a magnetic material having a honeycomb-shaped section is used, one in which small stainless steel balls are assembled, and one in which stainless steel rod members are assembled with gaps therebetween. In the heating magnetic body in which the small balls are assembled, spaces between the small balls constitute flow paths. In the heating magnetic body in which the rod members are assembled, gaps between the rod members constitute flow paths.

In addition, while the fluid to be heated has been the nitrogen gas in the above embodiments, the fluid may be air. It is to be noted, however, that in the case of air, an oxidizing action under heating becomes a problem, unlike in the case of the nitrogen gas. Therefore, the tubular insulating member should be configured using a non-oxide ceramic such as silicon nitride, and the electromagnetic induction coil and the like should have an anti-oxidation heat-resistant structure, like the electromagnetic induction coil 25.

While the electromagnetic induction heating apparatus according to the embodiments of the present invention has been described above, the modes of the present invention are not limited to the above-described embodiments, and include various modes within the scope of the gist of the invention.

REFERENCE SIGNS LIST

1 . . . Electromagnetic induction heating apparatus, 2 . . . Bottomed tubular container, 2*a* . . . Cylindrical wall section, 2*b* . . . Bottom wall section, 2*c* . . . Attachment flange, 3 . . . Base plate, 4 . . . Bolt, 5 . . . Nut; 10 . . . Tubular insulating member, 10*a*, 10*b* . . . Flange section, 10*s* . . . Annular stopper member, 11 . . . Cylindrical end member, 11*f* . . . Flange member, 12 . . . Cylindrical end member, 12*f* . . . Flange member, 13*a*, 13*b* . . . Packing, 14 . . . Flange member, 15 . . . Half-split annular member, 16 . . . Half-split annular member, 17*a*, 17*b* . . . Bolt, 18*a*, 18*b* . . . Nut; 20 . . . Heating magnetic body, 21 . . . Flat plate-shaped sheet member, 22 . . . Corrugated plate-shaped sheet member, 23 . . . Flow path, 25 . . . Electromagnetic induction coil; 30 . . . Inflow pipe, 31 . . . Cable passing port, 32 . . . Power cable, 35 . . . Outflow pipe, 35*a* . . . Large-diameter cylindrical section, 35*b* . . . Conical section, 35*c* . . . Small-diameter cylindrical section, 36 . . . Flange member, 37 . . . Bolt, 38 . . . Nut; 40 . . . Heating magnetic body,

41 . . . Pipe, 42 . . . Flow path; 50 . . . Heating magnetic body, 51 . . . Pipe, 52 . . . Flow path, 53, 54 . . . Flange member; 60 . . . Heating magnetic body, 61 . . . Flow path.

The invention claimed is:

1. An electromagnetic induction heating apparatus comprising:

a tubular insulating member formed in a tubular shape from a non-magnetic material and is provided with an inlet-side opening as an opening at an end portion on a side for serving as an inlet for a fluid, and an exit-side opening as an opening at an end portion on another side for serving as an exit for the fluid; and an outer shell member surrounding the tubular insulating member exclusively of the exit-side opening, wherein the outer shell member is provided, at a position nearer to the exit-side opening than to the inlet-side opening of the tubular insulating member, with an inflow port through which the fluid flows to inside of the outer shell member;

an electromagnetic induction coil is wound around an outer periphery of the tubular insulating member;

a heating magnetic body is disposed inside of the tubular insulating member in a state of forming a flow path the outer shell member is made up of a bottomed tubular container having a tubular wall section with a closed bottom wall at one end and an opening at another end, and a plate-shaped base plate closing the opening of the bottomed tubular container and provided with an outflow port, the exit-side opening of the tubular insulating member is connected to the outflow port provided in the base plate;

the bottomed tubular container has a bottom wall section bulging in a dome-like shape;

an annular space inside of the outer shell member and outside of an outer peripheral surface of the tubular insulating member is formed;

a tube inside space inside of the tubular insulating member is formed;

a communication space formed between a bottom surface of the bottom wall section of the bottomed tubular container and the inlet-side end portion of the tubular insulating member opposed to the bottom surface;

said inflow port is opening into the annular space; and a flow path in which the fluid flows into the annular space from the inflow port, flows into the communication space, flows into the tube inside space, and flows out from the tube inside space through the out flow port is formed.

2. The electromagnetic induction heating apparatus according to claim 1, wherein the outer shell member is made of a magnetic material.

3. The electromagnetic induction heating apparatus according to claim 1, wherein the inflow port is provided in the base plate.

4. The electromagnetic induction heating apparatus according to claim 1, wherein the tubular wall section of the bottomed tubular container is a cylindrical wall section cylindrical in shape, and the tubular insulating member is cylindrical in shape, and is disposed inside the cylindrical wall section of the bottomed tubular container with their respective cylinder center axes coincident with each other.

5. The electromagnetic induction heating apparatus according to claim 1, wherein the outflow port is made of a tubular outflow pipe penetrating the base plate and secured to the base plate.

6. The electromagnetic induction heating apparatus according to claim 1, wherein the tubular insulating member is made of a non-magnetic ceramic.

7. The electromagnetic induction heating apparatus according to claim 1, wherein the electromagnetic induction coil has a heat-resistant structure.

8. The electromagnetic induction heating apparatus according to claim 1, wherein the heating magnetic body has a plurality of flow paths arrayed such as to extend rectilinearly from the inlet-side opening toward the exit-side opening.

9. The electromagnetic induction heating apparatus according to claim 1, wherein the tubular insulating member with the electromagnetic induction coil wound therearound is assembled onto the base plate through an outflow pipe.

10. The electromagnetic induction heating apparatus according to claim 1, wherein the tubular insulating member with the heating magnetic body accommodated therein and with the electromagnetic induction coil wound therearound is unitized by attaching metallic cylindrical end members respectively to both ends thereof.

* * * * *